United States Patent [19]

Morimoto et al.

[11] Patent Number: 4,973,888

[45] Date of Patent: Nov. 27, 1990

[54] IMAGE DISPLAY DEVICE

[75] Inventors: Kiyoshi Morimoto; Hiroshi Watanabe; Yukio Ogawa, all or Mobara, Japan

[73] Assignee: Futaba Denshi Kogyo K.K., Mobara, Japan

[21] Appl. No.: 329,315

[22] Filed: Mar. 27, 1989

[30] Foreign Application Priority Data

Mar. 28, 1988 [JP] Japan ..... 63-071768
Apr. 15, 1988 [JP] Japan ..... 63-091665

[51] Int. Cl.[5] ..... H01J 29/70
[52] U.S. Cl. ..... 315/366; 313/422
[58] Field of Search ..... 315/366; 313/422

[56] References Cited

U.S. PATENT DOCUMENTS 4,525,653 6/1985 Smith ..... 315/366
4,542,322 9/1985 Irie et al. ..... 315/366

*Primary Examiner*—Gregory C. Issing
*Attorney, Agent, or Firm*—Oblon, Spivak, McClelland, Maier & Neustadt

[57] ABSTRACT

An image display device capable of uniforming luminance over a whole display plane. The image display device includes a plurality of vertical selecting electrodes each adapted to adjust an intensity of each of electron beams for every one of a plurality of cathodes. The device may include a protective electrode for insulating a low voltage region for selecting and deflecting of each electron beam and a high voltage region for accelerating the electron beam from each other.

3 Claims, 9 Drawing Sheets

IMAGE DISPLAY DEVICE

BACKGROUND OF THE INVENTION

1. Field of the Invention

This invention relates to an image display device for displaying an image such as a picture image, a projected image or the like, and more particularly to an image display device which is adapted to carry out addressing of a luminous point by a grid or deflecting electrode group using an electron beam accelerated under a high voltage, resulting in a display of a picture image, a projected image or the like. The present invention is suitable for use for a wall-mounting type television receiver, a high definition television, an OA (office automation) display, an FA (factory automation) display, a CAD (computer aided design) display and the like.

2. Background of the Invention

A display device of such type for a picture image or a projected image which has been conventionally known in the art generally includes a CRT (cathode ray tube) type display device which utilizes a so-called Braun tube.

The CRT type display device adapted to display a picture image or a projected image is so constructed that at least one electron beam emitted from an electron gun is scanned on a display plane of a screen having phosphors deposited thereon and accelerated and controlled electrons are impinged on a phosphor coated surface of the screen at a high velocity, to thereby carry out a luminous display. Such construction of the conventional CRT type display device permits the device to utilize a phosphor excited by a high velocity electron, resulting in readily accomplishing a color display of high luminance and high definition.

However, in the CRT type display device, not only the electron gun is provided with control means and arranged behind the screen, but scanning of the electron beam emitted from the electron gun in a manner to extend to an end of the screen requires the device to have a considerable depth, to thereby render thinning or lightening of the device highly difficult.

A graphic display device is proposed for the purpose of providing a thinly-made or thin display device substituted for the CRT type display device, to which a principle of a fluorescent display device is applied.

Such a fluorescent display device for graphic display utilizes a ZnO:Zn phosphor which is adapted to exhibit sufficient luminance when a low velocity electron impinges thereon, resulting in a monochromatic display. It exhibits sufficient utility when it is formed into a small size. However, it is driven at a low voltage and utilizes a flood electron beam or a diffused electron beam, so that the prior art substantially fails to provide a fluorescent display device of a relatively large size and a thin shape for a color graphic display.

More particularly, in the conventional fluorescent display device, an increase in the number of picture cells on a picture plane caused by large-sizing of the screen necessarily reduces its duty ratio, resulting in decreasing average luminance on the whole picture plane even when luminance of each picture cell is instantaneously increased. Accordingly, when it is desired to obtain required luminance on the picture plane, it is required to carry out emission of higher luminance from each picture cell. Unfortunately, a color phosphor excited by a low velocity electron is low in luminous efficiency, accordingly, driving of the phosphor at such a low voltage as described above fails to cause it to exhibit high luminance. Also, the phosphor fails to have a long life because it is rapidly deteriorated, as well as causes cathode pollution by decomposition products due to deterioration of the phosphor.

In view of the above, a flat-type color image display device is recently proposed which is formed into a thin shape as compared with the CRT type display device, driven at a high voltage and carries out addressing of a luminous section using an electrode group including a grid, a deflection electrode and the like.

FIG. 11 is an exploded perspective view schematically showing a basic structure of such a flat-type color image display device.

The color image display device generally includes an electrode group including a phosphor screen section 1 having a phosphor and an accelerating electrode deposited on an inner surface thereof and acting as a display plane, a plurality of filamentary cathodes 2 spaced from the phosphor screen section 1 and stretchedly arranged in a manner to be vertically spaced from each other and each horizontally extend along the phosphor screen section 1, a back electrode 3 arranged for directing electrons emitted from each of the filamentary cathodes 2 toward the phosphor screen section 1, a vertical focusing electrode 4 for focusing the emitted electrons in the vertical direction to form them into each electron beam, a vertical deflecting electrode 5 for deflecting the electron beams in the vertical direction, a horizontal selecting electrode 6 for selecting a horizontal direction of a display plane, a horizontal deflecting electrode 7 for deflecting the electron beams in the horizontal direction, and the like. The electrode group is received in a flat-type box-like envelope of which an interior is evacuated to and kept at a high vacuum.

The conventional color image display device constructed as described above is so operated that each electron beam emitted from each of the filamentary cathodes 2 is selectively impinged on each of picture cells defined on the inner surface of the phosphor screen section 1 at a high velocity while being controlledly deflected in the vertical and horizontal directions by the electrodes 4 to 7, resulting in a desired luminous display.

In the conventional color image display device, the back electrode 3 and vertical focusing electrode 4 each are formed by a common single plate and a predetermined voltage is applied to the back electrode 3 and vertical focusing electrode 4, and further a pulse voltage is applied to a plurality of the filamentary cathodes 2 from one end of each of the cathodes to the other end thereof in order, so that the electron beams are fed in order depending on a relationship in potential between the back electrode 3 and the vertical focusing electrode 4, resulting in selecting a vertical position on the display plane.

However, techniques for manufacturing the conventional color image display device certainly fail in proper or uniform aligning of the cathodes 2 with the back electrode 3 and vertical focusing electrode 4, so that each of the cathodes 2 are not necessarily uniformly or regularly positioned with respect to the electrodes. Also, there occurs a dispersion in electron emitting capacity among the cathodes 3. This causes the amount of electrons fed from the respective cathodes 2 through the vertical focusing electrode 4 toward the phosphor screen section 1 to be varied depending on the cathode.

Unfortunately, it is highly difficult to adjust the amount of electrons contained in each electron beam taken out through the vertical focusing electrode 4 because each of the back electrode 3 and vertical focusing electrode 4 is formed by a common single plate as described above, resulting in unevenness in luminance tending to occur on the display plane. Further, in the conventional color image display device, as described above, electrons emitted from each of the cathodes 2 is shaped into an electron beam by the vertical focusing electrode 4 and horizontal selecting electrode 6, which is then selectively impinged on the picture cells on the phosphor screen section 1 while being accelerated by the section 1 after it is deflected by the vertical deflecting electrode 5 and horizontal deflecting electrode 7, resulting in a desired luminous display. In this instance, in order to facilitate selective control of each electron beam and controlled deflection of it, it is desired to carry out the above-described operation at a low voltage.

However, the above-described construction of the conventional display device causes the horizontal deflecting electrode 7 to be affected by a region of the phosphor screen section 1 to which a high voltage is applied because the electrode 7 is exposed directly to the phosphor screen section 1 also serving as an accelerating electrode, to thereby render the horizontal deflection at such a low voltage as described above difficult. This leads to a decrease in deflecting sensitivity of the horizontal deflecting electrode 7, as well as tends to cause electrical discharge between the horizontal deflecting electrode 7 and the phosphor screen section 1. Such discharge adversely affects a deflecting circuit connected to the horizontal deflecting electrode 7 and the like to often lead to damage of the circuit.

As an approach to such disadvantages, it would be considered that a protective electrode is interposedly arranged between the horizontal deflecting electrode 7 and the phosphor screen section 1. However, in this instance, it is highly required to effectively prevent the protective electrode from affecting control for selection and deflection at the address section, accordingly, arrangement of the protective electrode is not desirable.

SUMMARY OF THE INVENTION

The present invention has been made in view of the foregoing disadvantage of the prior art.

Accordingly, it is an object of the present invention is to provide a thinly-made or thin color image display device of the flat type which is capable of adjusting an intensity of an electron beam by a vertical selecting electrode for every cathode, to thereby uniform luminance on a display image plane as much as possible.

It is another object of the present invention to provide an image display device which includes a protective electrode functioning to protect a low voltage region for carrying out selection and deflection of each electron beam from a high voltage region for accelerating the electron beam without affecting addressing of the electron beam in the low voltage region.

In accordance with one aspect of the present invention, an image display device is provided which includes a plurality of filamentary cathodes each arranged for emitting electrons therefrom, a selecting electrode group for focusing the electrons emitted from each of the cathodes to form them into each electron beam and controlledly selecting each electron beams, a deflecting electrode group for controlledly deflecting each selected electron beam in the vertical and horizontal directions, means for applying a drive voltage to each of the selecting and deflecting electrode groups, an accelerating electrode group for accelerating each deflected electron beam, means for applying a drive voltage to the accelerating electrode group, a phosphor screen section arranged for functioning as an anode side display plane which carries out emission upon impinging of each accelerated electron beam thereon, and an envelope for arranging the cathodes and electrode groups therein, which is evacuated to a high vacuum.

In the image display device of the present invention constructed as described above, adjustment of the voltage applied to the selecting electrode group corresponding to at least each of the cathode permits an intensity of each electron beam to be uniformed as much as possible irrespective of an electron emitting capacity of each cathode and a variation in position of arrangement of each cathode with respect to the selecting electrode group, resulting in luminance of a display on an anode display plane in the phosphor screen section being readily adjusted.

In accordance with another aspect of the present invention, an image display device is provided which includes a plurality of filamentary cathodes each arranged for emitting electrons therefrom, a selecting electrode group for focusing the electrons emitted from each of the cathodes to form them into each electron beam and controlledly selecting each electron beam, a deflecting electrode group for controlledly deflecting each selected electron beam in the vertical and horizontal directions, means for applying a drive voltage to each of the selecting and deflecting electrode groups, an accelerating electrode group for accelerating each deflected electron beam, means for applying a drive voltage to the accelerating electrode group, a phosphor screen section arranged for functioning as an anode side display plane which carries out emission upon impinging of each accelerated electron beam thereon, a protective electrode interposed between a low voltage region side by the selecting and deflecting electrode groups and a low voltage region side by the accelerating electrode group and anode and formed with an aperture corresponding to a range of deflection of each electron beam in at least any one of the vertical and horizontal directions, and an envelope for arranging the cathodes and electrode groups therein, the envelope being evacuated to a high vacuum.

In the so-constructed image display device, adjusting of the voltage applied to at least the selecting electrode group permits an intensity of each electron beam to be uniformed as much as possible, and arrangement of the protective electrode permits the high voltage region and low voltage region to be separated from each other, to thereby facilitate selection and deflection of the electron beam at a low voltage and effectively prevent an electrical field on the high voltage region side from affecting the low voltage region side, resulting in accurate addressing of the electron beam.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 6(*b*) is a schematic view showing relationships between an equipotential surface and an electron beam path in the case that no anode diffuser is arranged;

DETAILED DESCRIPTION OF THE PREFERRED EMBODIMENT

Figure 1:
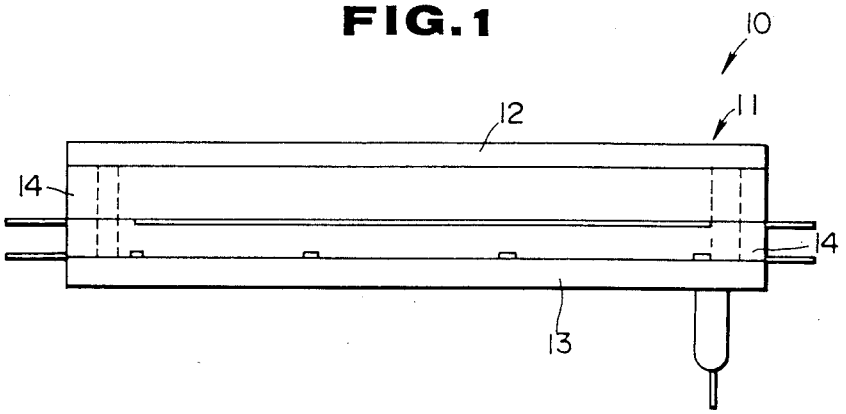
FIG. 1 is a side elevation view generally showing an embodiment of an image display device according to the present invention.

Now, an image display device according to the present invention will be described hereinafter with reference to FIGS. 1 to 10 of the accompanying drawings, in which like reference numerals designate like or corresponding parts throughout.

Figure 2:
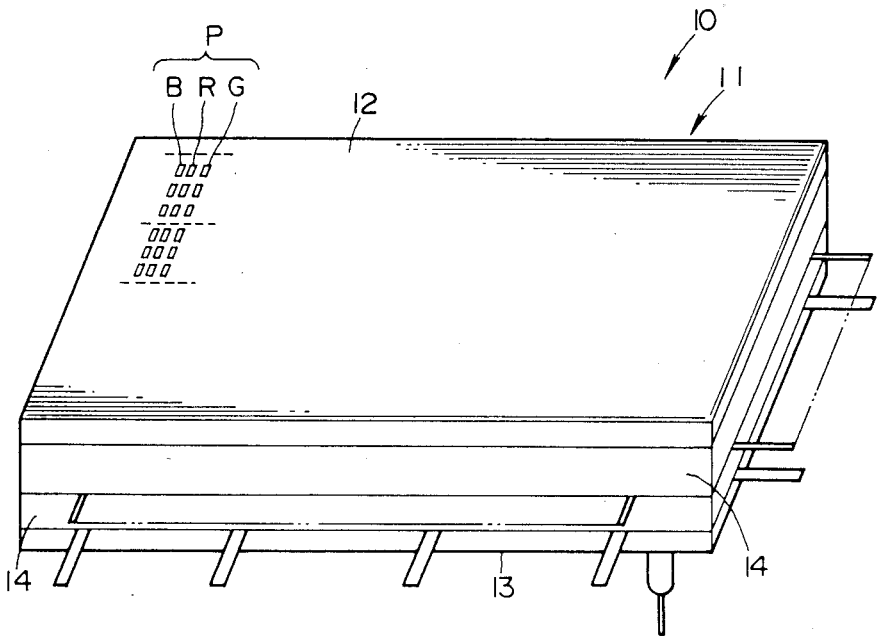
FIG. 2 is a perspective view of the image display device shown in FIG. 1.

FIGS. 1 and 2 are a side elevation view and a perspective view showing a general construction of an embodiment of an image display device according to the present invention, respectively.

An image display device of the illustrated embodiment generally designated at reference 10 in FIGS. 1 and 2 includes a flat-type box-like envelope 11 constituted by a front cover 12 made of a light-permeable insulating material such as glass and serving as a display plane, a rear plate 13 arranged opposite to the front cover 12 through a space therebetween and likewise formed of an insulating material such as a glass sheet, side plates 14 arranged between the front cover 12 and the rear plate 13 and likewise formed of an insulating material such as a glass sheet which are assembled together by means of a suitable sealing material. In the envelope 11 is arranged a laminated structure comprising cathodes and other electrodes described hereinafter. Then, the envelope 11 is evacuated to a high vacuum.

As shown in FIGS. 1 and 2, lead terminals are outwardly led out through sealing portions between the respective plate members constituting the envelope 11 from electrodes received in the envelope. Also, on an inner surface of the front cover 12 is arranged a phosphor screen section 20 which serves as a display plane and is formed by arranging, in the horizontal direction, a plurality of picture cells P each comprising a phosphor R of red luminous color, a phosphor G of a green luminous color and a phosphor B of a blue luminous color which are arranged in a stripe- or dot-like manner on the inner surface of the front cover.

The words "horizontal direction" used herein for indicating directions of arrangement of each picture cell and the like mean a direction in which the phosphors R, G and B of each picture cell are arranged side by side in a row. This corresponds to a longitudinal direction of the envelope 11. The words "horizontal direction" used herein indicate a direction perpendicular to the horizontal direction defined above.

Now, the laminated structure comprising various electrodes received in the envelope 11 will be described.

Figure 3:
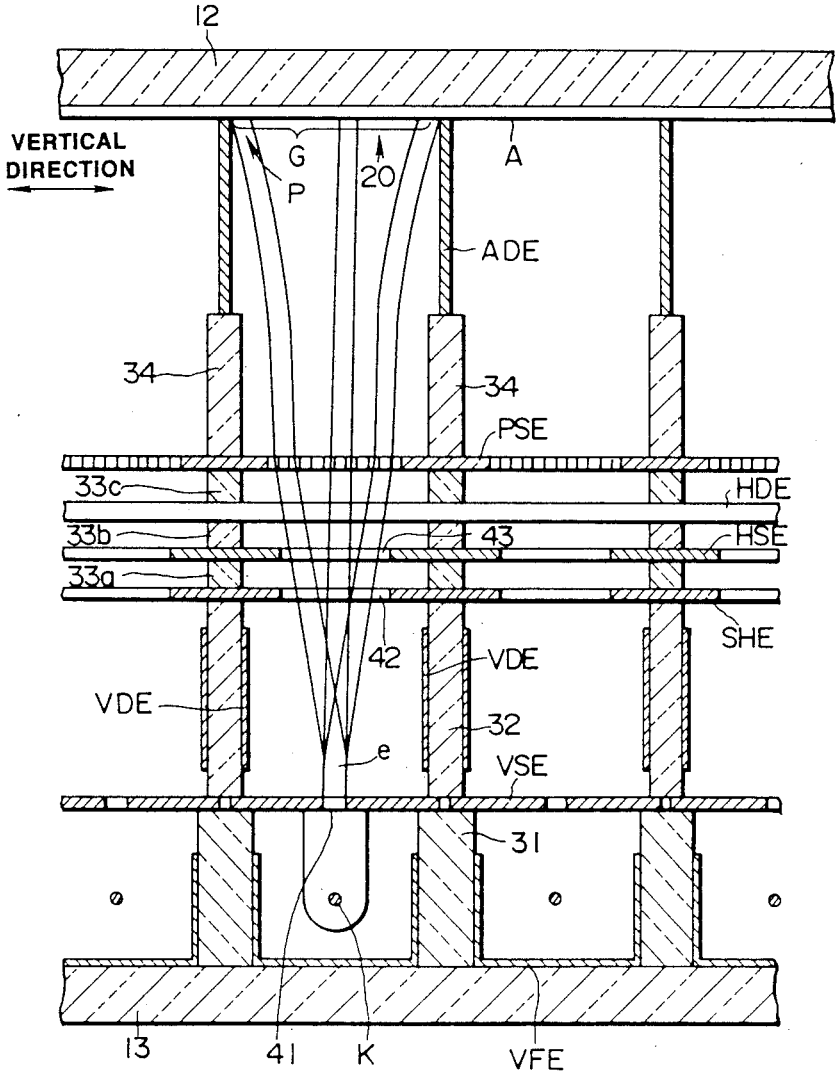
FIG. 3 is a fragmentary enlarged cross-sectional view schematically generally showing an electrode structure in the image display device shown in FIG. 1.
Figure 4:
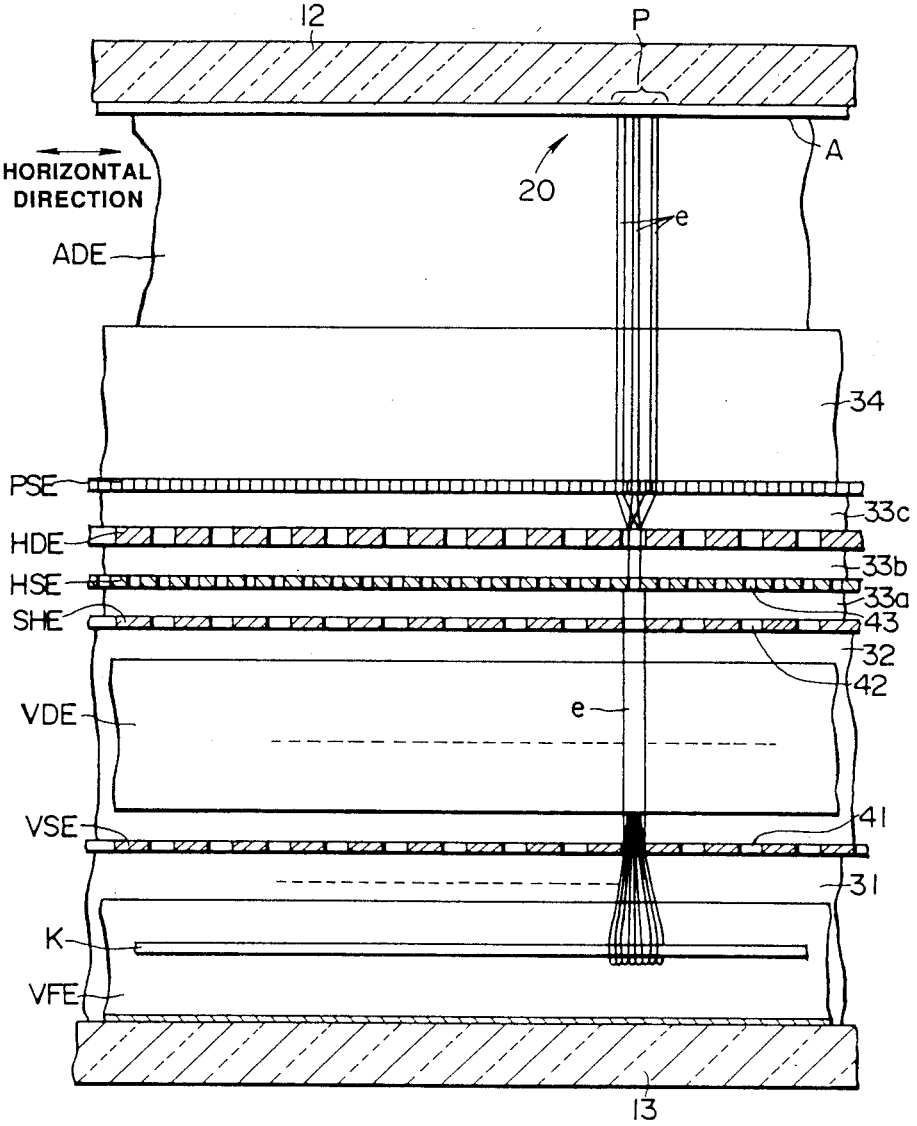
FIG. 4 is a fragmentary enlarged vertical sectional view of the electrode structure shown in FIG. 3.

FIGS. 3 and 4 are fragmentary enlarged sectional views of an electrode structure taken in the horizontal direction and the vertical direction, respectively.

As shown in FIGS. 3 and 4, a plurality of filamentary cathodes K are stretchedly arranged adjacent to an inner surface of the rear plate 13 in a manner to extend in the horizontal direction and be in parallel with one another. The cathodes K each may be the directly heated type. However, it is preferably the indirectly heated type when it has a large length, because a directly heated type cathode exhibit a small potential gradient. The cathodes are operated to emit electrons. Also, on the inner surface of the rear plate 13 are arranged a plurality of vertical focusing electrodes VFE each formed into a substantially U-shape and acting as a back electrode. The vertical focusing electrodes VFE each are disposed in a manner to surround rear and side portions of each of the cathodes K. Between each adjacent two cathodes K and therefore between each adjacent two vertical focusing electrodes VFE is arranged an insulating partition plate 31 which serves to not only carry out shielding between the cathodes but support electrodes arranged forwardly. The vertical focusing electrodes VFE each function to focus electrons emitted from the corresponding cathode K in the vertical direction to form them into a strip-like electron beam e and then direct it forwardly.

In front of each of the insulating partition plates 31 is arranged a vertical selecting electrode VSE which is formed into an elongated shape in the horizontal direction. The vertical selecting electrodes VSE are arranged in a manner to be separated from one another corresponding to the respective cathodes K. Each of the vertical selecting electrodes VSE is formed with an aperture or slit 41 in the direction of extension of the cathode K (vertical direction), resulting in restricting the electron beam e emitted from the cathode K. A voltage applied to the vertical selecting electrode VSE is subjected to ON-OFF control to carry out selection in the vertical direction, resulting in scanning of the electron beam e. Also, adjustment of the applied voltage in the ON state causes a potential of the vertical selecting electrode VSE relative to the vertical focusing electrode VFE to be varied to control the electron beam e emitted from the corresponding cathode K, resulting in uniforming an intensity of the electron beam as much as possible.

In front of each of the vertical selecting electrodes VSE is disposed an insulating partition supporting plate 32, and on side surfaces of each supporting plate 32 opposite to each other are arranged a pair of vertical deflecting electrodes VDE formed of a thin film, a thick film or a plate material. Each pair of the vertical deflecting electrodes VDE for every one display section G of each picture cell P defined by at least each insulating partition supporting plate 32 are electrically separated from each other and, in the illustrated embodiment, the vertical deflecting electrodes VDE each arranged on one side surface of each of the insulating partition supporting plates 32 are connected together and the electrodes each arranged on the other side surface of each of the supporting plates 32 are likewise connected together. To each pair of the vertical deflecting electrodes VDE is applied a DC voltage together with a rectangular pulse voltage or a step-like pulse voltage superposed thereon. The DC voltage is applied for the purpose of being cooperated with the vertical selecting electrode VSE and a shielding electrode SHE described hereinafter to controlledly focus the electron beam e, whereas the pulse voltage is applied to controlledly deflect the beam in the vertical direction.

The shielding electrode SHE is wholly formed into a onepiece sheet and arranged in front of the insulating partition supporting plate 32. The shielding electrode SHE is formed with long apertures 42 of a slit-like shape each corresponding to an angle of deflection of the electron beam in the vertical direction to forwardly direct the electron beam without disturbing it. Also, its shape in the vertical direction is formed corresponding to a long aperture of a slit-like or reticulate shape formed at each horizontal selecting electrode HSE described hereinafter. The shielding electrode SHE functions to not only regulate a width of the electron beam in the horizontal direction but shield the horizontal selecting electrode HSE to prevent interference between the horizontal selecting electrodes HSE adjacent to each other or a so-called cross talk which is a phenomenon causing the electron beam to be concentrated on a horizontal selecting electrode HSE turned on and a horizontal selecting electrode HSE turned off to affect the turned-on horizontal selecting electrode HSE, resulting in the turned-on electrode being kicked.

The horizontal selecting electrodes HSE are arranged through insulating spacers 33*a* in front of the shielding electrode SHE. The horizontal selecting electrode HSE is formed with a long aperture 42 of a slit-like or reticulate shape corresponding to the angle of deflection of the electron beam in the vertical direction in a manner to correspond to each aperture 42 of the shielding electrode SHE. The apertures 42 are arranged on by one in a manner to be electrically separated from each other for every at least one of the picture cells P arranged side by side in the horizontal direction, resulting in a display signal being supplied to the horizontal selecting electrodes HSE. The display signal applied may be a digital signal subjected to pulse width modulation. Alternatively, it may be an analog signal or a digital signal subjected to amplitude modulation.

In front of the horizontal selecting electrodes HSE is arranged at least one horizontal deflecting electrode HDE through insulating spacers 33*b*. In the illustrated embodiment, a plurality of the horizontal deflecting electrodes HDE formed into an elongated shape are arranged so as to extend in the vertical direction and interpose the focused electron beam e therebetween. The electrodes HDE are alternately connected together. The horizontal deflecting electrodes HDE each are applied thereto a DC voltage together with a rectangular pulse voltage or step-like pulse voltage superposed thereon for the same reason described above in connection with the vertical deflecting electrode VDE. This causes the electron beam passing through each of the horizontal deflecting electrodes HDE to be selectively and accurately impinge on each phosphor array comprising the phosphors R, G and B arranged in a stripe- or dot-like manner in each picture cell P of the phosphor screen section 20 formed on the inner surface of the front cover 12.

Further, in front of the horizontal deflecting electrodes HDE is arranged a protective electrode PSE through insulating spacers 33*c*. The protective electrode PSE functions to separate a high voltage region defined on the side of the front cover 12 for accelerating the electron beam e deflected in the vertical and horizontal directions and a low voltage region in which horizontal and vertical deflecting and selecting electrodes and the like are arranged from each other. Also, the protective electrode PSE is constructed into a mesh-like structure for passing the electron beam e therethrough without disturbing a flow of the electron beam e. However, the protective electrode PSE may be a plate-like electrode formed with a long aperture of a size sufficient to permit each electron beam e to readily pass therethrough.

Figure 5:
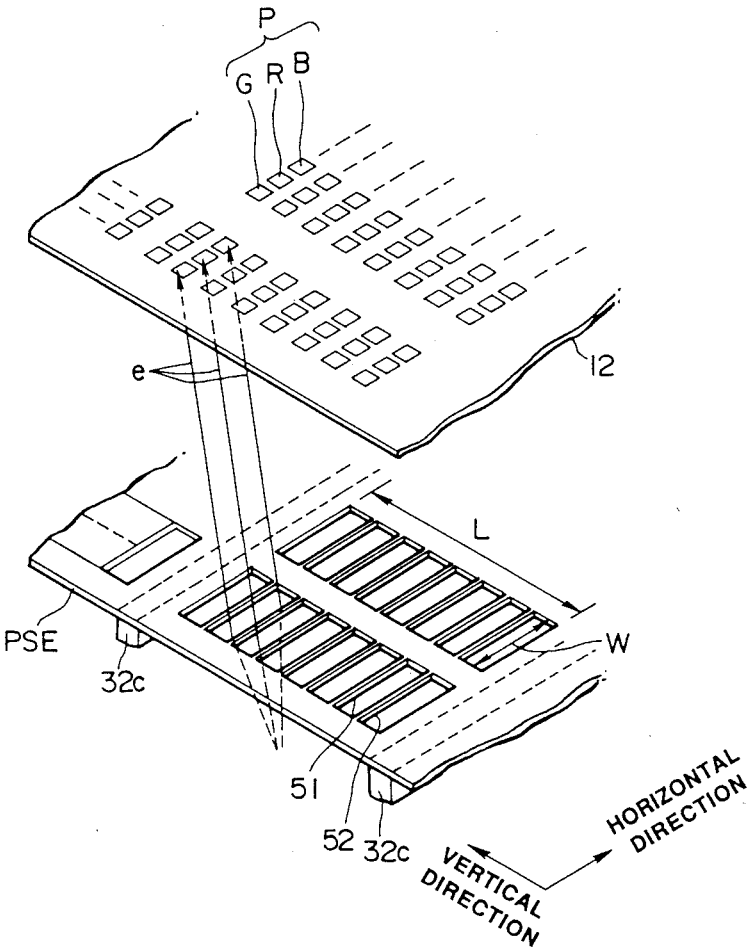
FIG. 5 is an exploded perspective view generally showing a protective electrode in the image display device shown in FIG. 1.
Figure 6:
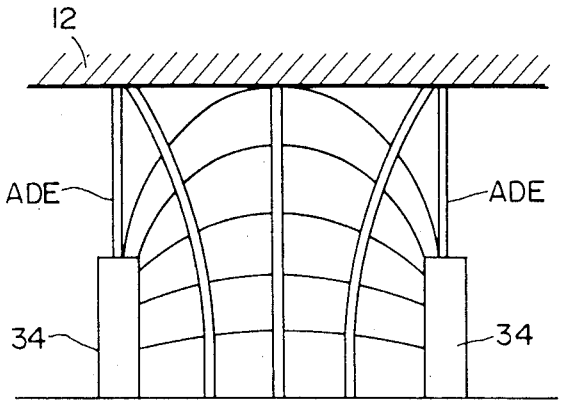
FIG. 6(*a*) is a schematic view showing relationships between an equipotential surface and an electron beam path in the case that anode diffusers are arranged.
Figure 6:
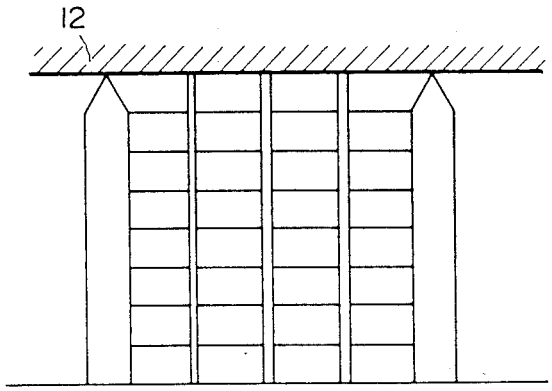

The protective electrode PSE may be constructed in a manner as shown in FIG. 5.

More particularly, the protective electrode PSE is formed with apertures 51 each having a configuration sufficient to permit each electron beam e subjected to vertical deflection and horizontal deflection to pass therethrough without causing a potential of the protective electrode PSE to disturb a flow of the electron beam e. In the illustrated embodiment, a width W of each of the apertures 51 in the horizontal direction is formed into a dimension larger than at least a width of deflection of the electron beam e deflected by the horizontal deflecting electrode HDE. A width L of the aperture 51 in the vertical direction is formed into a dimension larger than a maximum width of deflection of the electron beam e by each pair of the vertical deflecting electrodes VDE. The maximum width is defined at a position of the protective electrode.

However, when the apertures 51 are substantially formed in all the vertical and horizontal directions, it is highly difficult to keep a strength of the protective electrode PSE itself at a predetermined level. Accordingly, in the illustrated embodiment, the protective electrode PSE is provided with reinforcing members 52 of a wire-like shape, which are arranged so as to extend in the horizontal direction, to thereby ensure a required strength of the protective electrode PSE. Such arrangement of the reinforcing members 52 causes them to cross a vertical deflection path of the electron beam e. However, such arrangement does not adversely affect the electron beam e so long as the reinforcing members 52 each are formed into a significantly small diameter.

As will be described in detail hereinafter, in the phosphor screen section 20, the three phosphors R, G and B constituting each picture cell P and arranged in a stripe- or dot-like manner are separately arranged in order in the horizontal direction. Also, in the vertical direction, eight picture cells P are arranged side by side corresponding to each of the apertures 52. Accordingly, the illustrated embodiment effectively prevents disadvantages such as color shift and the like which significantly adversely affect a luminous display, so long as addressing of the electron beam e in the horizontal direction is accurately carried out. In other words, the above-described arrangement of the reinforcing members 52 in each of the apertures 51 does not substantially adversely affect a flow of the electron beam e, even when they somewhat disturb the flow. Further, the reinforcing members 52 exhibits an advantage of uniforming a distribution of an electrical field between a peripheral portion of the corresponding aperture 51 and its central portion as much as possible, to thereby prevent focusing of the electron beam e from being deteriorated, as well as prevent an electrical field in the high voltage region from affecting the low voltage region through the aperture 51.

Further, the image display device of the illustrated embodiment includes insulating supports 34 made of an insulating material such as glass, ceramic or the like and arranged in front of the protective electrode PSE. The insulating supports 34 function to electrically separate the high voltage region defined on an anode A arranged on an inner surface of the front cover 12 from the low voltage region defined behind the protective electrode PSE.

Between each of the insulating supports 34 and the front cover 12 or anode A is arranged an anode diffuser ADE, and a high voltage as high as 10kV is applied to each of the anode diffusers ADE and the anode A. The anode diffusers ADE function to not only support the front cover 12 thereon but control an electrical field in the high voltage region, to thereby permit the electron beam e subjected to vertical deflection to effectively impinge on a portion of picture cell P positioned on an endmost side in the high voltage region defined by the anode diffuser ADE, as shown in FIG. 6(a). Supposing that the anode diffusers ADE are not provided, an electrical field in a space between the insulating supports 34 is rendered uniform as shown in FIG. 6(b), resulting in the electron beam e failing to reach the portion of the picture cell P on the endmost side of the high voltage region.

Figure 7:
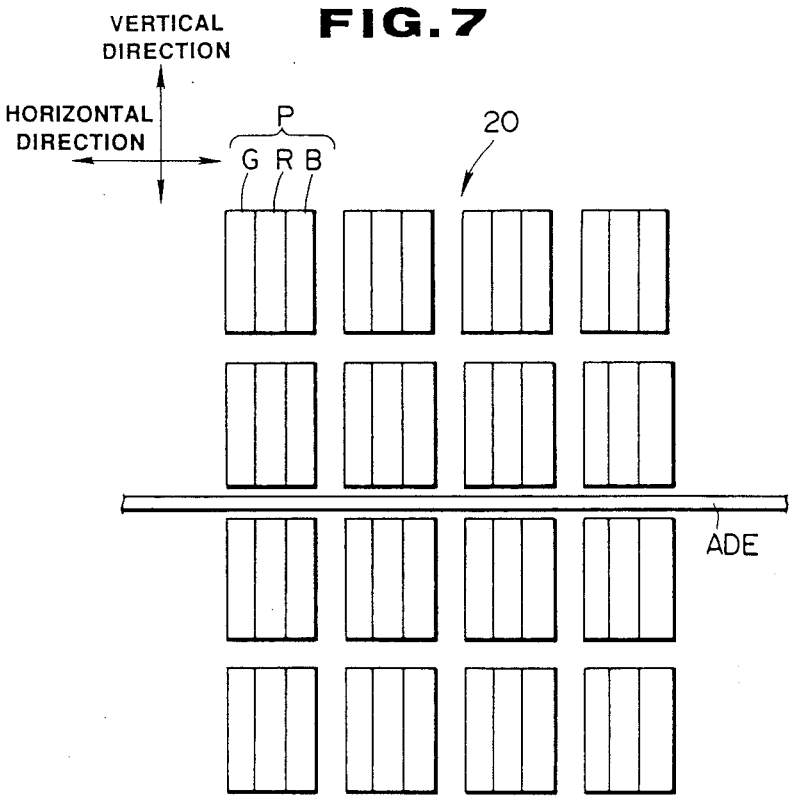
FIG. 7 is a schematic view showing arrangement of picture cells in a phosphor screen section in the image display device shown in FIG. 1.
Figure 8:
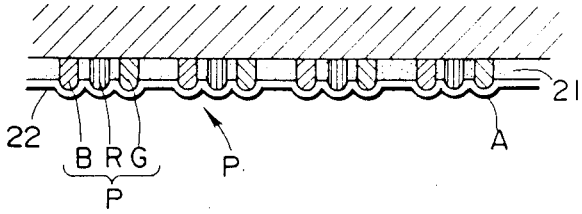
FIG. 8 is a fragmentary section view of the phosphor screen section shown in FIG. 7.

As shown in FIG. 7, the phosphor R of a red luminous color, phosphor G of a green luminous color and phosphor B of a red luminous color are deposited on the inner surface of the front cover 12 in a stripe-like or dot-like manner. The phosphors R, G and B are arranged side by side in the horizontal direction to form each picture cell P. The picture cells P each formed as described above are arranged at predetermined intervals in the vertical and horizontal directions to form the phosphor screen section 20 serving as a display plane. Also, as shown in FIG. 8, between each adjacent two of the phosphors R, G and B is interposedly arranged a black or dark mask 21 for improving the contrast therebetween, and on each of the masks 21 a metal back layer 22 made of aluminum, resulting in the abovedescribed anode A being formed.

As will be understood from the foregoing, in the image display device of the illustrated embodiment constructed as described above, a space between the focusing electrodes VFE and the horizontal deflecting electrodes HDE is defined as the low voltage region which functions to highly uniform an intensity of each of the electron beams e and carry out selection and deflection of the electron beam e for addressing of the electron beam; whereas the anode diffusers ADF and the anode A of the phosphor screen section 20 cooperate together to define the high voltage region for accelerating the addressed electron beam e at a high electrical field to impinge it on each of the phosphors R, G and B of each picture cell P in each display plane G. The low voltage region is protected from the high voltage region by the protective electrode PSE.

Now, the manner of operation of the image display device of the illustrated embodiment constructed as described above will be described hereinafter.

First, a voltage of a predetermined level is applied to the cathodes K from a common power supply to heat them, resulting in electrons being emitted from the cathodes K.

Also, to the focusing electrodes VFE is applied a voltage of, for example, about 0 to −10V determined on the basis of the voltage applied to the cathodes K, so that electrons emitted from each of the cathodes K focused into a strip-like electron beam e, which is then forwardly directed.

When each of the vertical selecting electrodes VSE separated from one another is turned on, a voltage of, for example, about 30 to 100V is applied to each of the electrodes. This results in the vertical direction being selected to carry out scanning of each of the electron beams e, as well as the electron beam being further restricted to a degree sufficient to permit it to pass through the slit 41 of each of the vertical selecting electrodes VSE.

When a voltage applied to the vertical selecting electrodes VSE at the time of turning on the vertical selecting electrodes VSE is adjusted within a range of, for example, 10 to 100V to vary a relative potential difference between the verticals electing electrodes VSE and the focusing electrodes VFE, an intensity of each electron beams e emitted from each of the cathodes K and then forwardly directed through the slits 41 can be controlled as desired. Also, such control of the intensity can be independently carried out depending on the electron beam as desired, because the vertical selecting electrodes VSE are electrically separated from one another corresponding to the cathodes K. Accordingly, the cathodes can be independently stretched irrespective of a variation in electron emitting capacity and position of the cathodes K, resulting in luminance being rendered uniform over the whole display place.

Then, a DC voltage of, for example, about 30 to 100V is applied to each pair of the vertical deflecting electrodes VDE, and also a rectangular pulse voltage or step-like pulse voltage of about ±20 to 60V is applied thereto in a manner to be superposed on the DC voltage, to thereby form a step-like potential difference between each pair of the electrodes with the electron beam e being interposed therebetween. This results in each focused electron beams e being deflected in the vertical direction, so that the vertical position of, for example, each eight picture cells P arranged side by side in the vertical direction in each one display section G defined by the anode diffusers ADE may be selected and each focused electron beams may be further restricted into a small diameter by potentials of each pair of the vertical deflecting electrodes VDE and each vertical selecting electrode VSE.

Further, each of the electron beams e deflected in the vertical direction passes through the shielding electrode SHE, horizontal selecting electrode HSE and horizontal deflecting electrode HED in turn, during which a voltage of, for example, about 30 to 100V is applied to the shielding electrode SHE, so that a width of the focused electron beam e in the horizontal direction is regulated when it passes through the slit-like aperture 42 of the shielding electrode SHE. Also, the horizontal selecting electrode HSE is applied thereto a voltage of, for example, about 10 to 100V, resulting in the selection in the horizontal direction taking place. In addition, the horizontal deflecting electrode HDE is applied thereto a DC voltage of, for example, about 30 to 100V, and also a rectangular pulse voltage or step-like pulse voltage of about ±10 to 30V is applied thereto in a manner to be superposed on the DC voltage to form a step-like potential difference between each pair of the electrodes arranged opposite to each other with the electron beam e being interposed therebetween. Thus, each of the electron beams e deflected in the vertical direction as described above is deflected in the horizontal direction, resulting in the vertical position of each of the picture cells P arranged side by side in the horizontal direction in the above-described one display section G being selected. The above-described operation is carried out in the low voltage region.

Controlled focusing of each focused electron beam e in the vertical direction on the side of the low voltage region is carried out by adjusting the DC voltage of the vertical deflecting electrode VDE and the voltage of the vertical focusing electrode VFE, whereas controlled focusing of the electron beam in the horizontal direction is accomplished by adjusting the DC voltage of the horizontal deflecting electrode HDE and the voltages of the horizontal selecting electrode HSE and shielding electrode SHE.

Subsequently, each of the electron beams e thus deflected in both the vertical and horizontal direction enters the high voltage region after it passes through the protective electrode PSE to which a voltage of, for example, about 0 to 100V is applied, so that in the high voltage region, a course of the electron is controlled by the anode A and each of the anode diffusers ADE having a high voltage of about 10kV applied thereto. This permits each of the focused electron beams e to reach the picture cell P positioned at the end in each display section G defined by the anode diffusers ADE and selectively impinge on the phosphors R, G and B of the phosphor screen section 20 as desired, resulting in a desired luminous display.

During the operation, the low voltage region and high voltage region are effectively shielded from each other by the protective electrode PSE, to thereby positively prevent an electrical field in the high voltage region from entering the low voltage region to adversely affect it. Accordingly, the illustrated embodiment effectively accelerates the electron beam e at a high voltage without disturbing deflection or addressing of the electron beam in the low voltage region.

Figure 9:
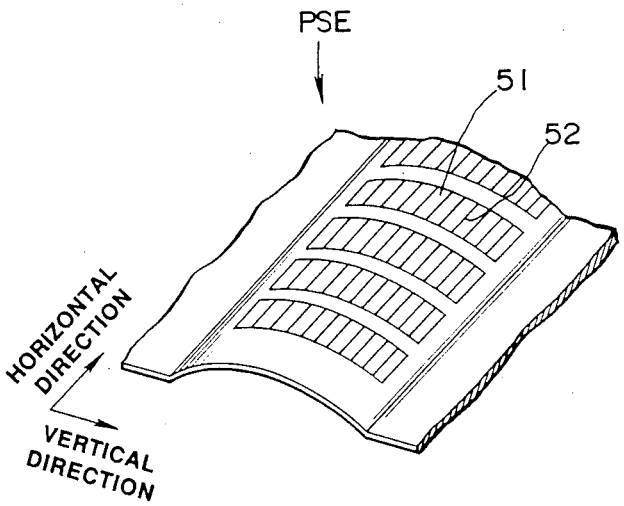
FIG. 9 is a perspective view showing a modification of a protective electrode.
Figure 10:
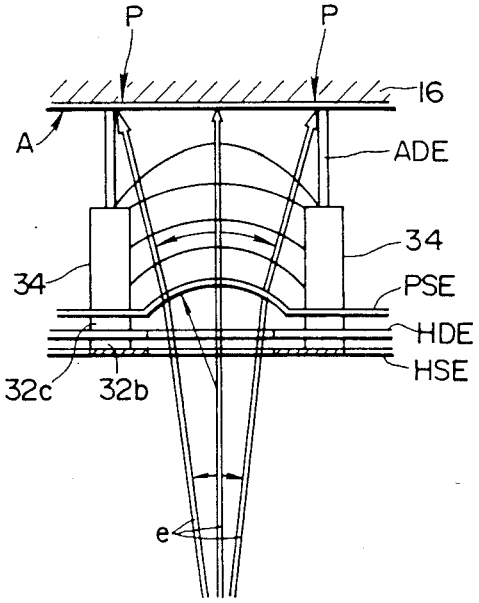
FIG. 10 is a schematic vertical view showing an essential part of an image display device in which the protective electrode of FIG. 9 is arranged.
Figure 11:
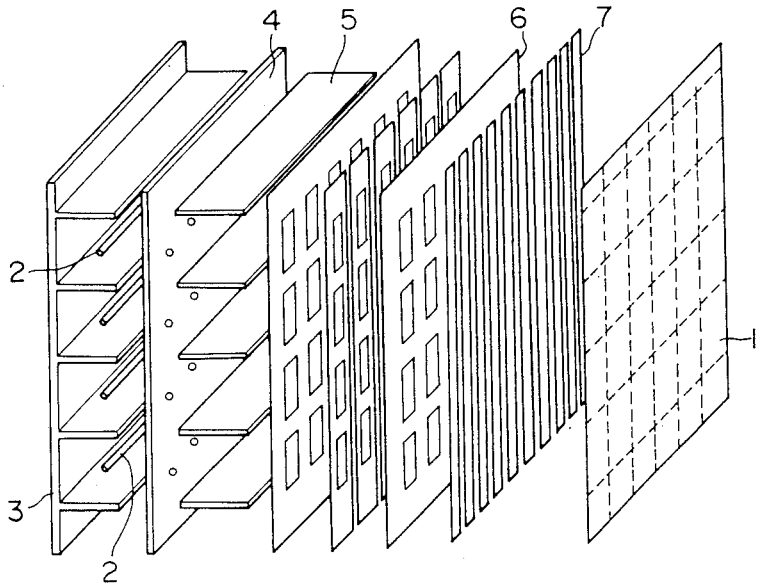
FIG. 11 is a schematic exploded perspective view generally showing a basic construction of a conventional color image display device.

In the illustrated embodiment described above, the protective electrode is formed into a flat shape as shown in FIG. 5. However, it may be formed into such a configuration as shown in FIG. 9. More specifically, it may be formed into an arcuate shape in section by expanding a central portion thereof in the vertical direction. Such configuration of the protective electrode PSE more facilitates vertical deflection of the electron beam. More particularly, the arcuate configuration causes an accelerating field formed in the high voltage region to likewise have an arcuate shape as shown in FIG. 10, and the electron beam accelerated by the arcuate electrical field is spread into a fan-like shape, so that the electron beam may positively reach a region in close proximity to the anode diffuser ADE. This permits a wider vertical deflection angle to be obtained so long as a distance between the protective electrode PSE and the phosphor screen section 20 is constant. Also, this permits a thickness of the whole device to be further reduced so long as a range of the vertical deflection angle is constant, because it is possible to decrease the distance between the electrode PSE and the phosphor screen section 20.

While a preferred embodiment of the invention has been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. An image display device comprising:

a plurality of filamentary cathodes each arranged for emitting electrons therefrom;

a plurality of U-shaped vertical focusing electrodes insulated from each other and each serving as a back electrode, surrounding in a one to one relationship said filamentary cathodes for focusing electrons emitted from said cathodes;

a selecting electrode group for focusing said electrons emitted from each of said cathodes to form them into each electron beam and controlledly selecting said each electron beams;

a deflecting electrode group for controlledly deflecting said each selected electron beam in the vertical and horizontal directions;

means for applying a drive voltage to each of said selecting and deflecting electrode groups;

an accelerating electrode group for accelerating said each deflected electron beam;

means for applying a drive voltage to said accelerating electrode group;

a phosphor screen section arranged for functioning as an anode side display plane which carries out emission upon impinging of said accelerated each electron beam thereon;

means for adjusting of said voltage applied to at least said selecting electrode group to permit an intensity of each electron beam to be uniformed;

a plurality of vertical selecting electrodes each arranged in front of each of said vertical focusing electrodes and formed with an aperture for restricting said focused electrons, adjusting of a voltage applied to each of said electrodes causing an intensity of each electron beam to be uniformed; and an envelope for arranging said cathodes and electrode groups therein, said envelope being evacuated to a high vacuum.

2. An image display device comprising:

a plurality of filamentary cathodes each arranged for emitting electrons therefrom;

a plurality of U-shaped vertical focusing electrodes insulated from each other and each serving as a back electrode, surrounding in a one to one relationship said filamentary cathodes for focusing electrons emitted from said cathodes;

a selecting electrode group for focusing said electrons emitted from each of said cathodes to form them into each electron beam and controlledly selecting said each electron beams;

a deflecting electrode group for controlledly deflecting said each selected electron beam in the vertical and horizontal directions;

means for applying a drive voltage to each of said selecting and deflecting electrode groups;

an accelerating electrode group for accelerating said each deflected electron beam;

means for applying a drive voltage to said accelerating electrode group; and a phosphor screen section arranged for functioning as an anode side display plane which carries out emission upon impinging of said accelerated each electron beam thereon;

a protective electrode separating the high voltage region in which the accelerating electrode group and the anode group are arranged from the low voltage region in which horizontal and vertical deflecting and selecting electrode groups are arranged;

means for adjusting of said voltage applied to at least said selecting electrode group to permit an intensity of each electron beam to be uniformed;

arrangement of said protective electrode eliminating affection from said high voltage region side to said low voltage region;

a plurality of vertical selecting electrodes each arranged in front of each of said vertical focusing electrodes and formed with an aperture for restricting said focused electrons, adjusting of a voltage applied to each of said electrodes causing an intensity of each electron beam to be uniformed; and an envelope for arranging said cathodes and electrode groups therein, said envelope being evacuated to a high vacuum.

3. An image display device as defined in claim 2, wherein said protective electrode interposedly arranged between said low voltage region and said high voltage region side is formed at at least a part thereof into an arcuate shape on a side thereof in at least any one of the vertical and horizontal directions.

* * * * *